US007661327B2

(12) United States Patent
Bourgein et al.

(10) Patent No.: US 7,661,327 B2
(45) Date of Patent: Feb. 16, 2010

(54) METHOD AND SYSTEM FOR DYNAMIC SENSING, PRESENTATION AND CONTROL OF COMBUSTION BOILER CONDITIONS

(75) Inventors: John Frank Bourgein, 42 El Camino Moraga, Orinda, CA (US) 94563; Eric Fischer, Orinda, CA (US)

(73) Assignee: John Frank Bourgein, Orinda, CA (US)

( * ) Notice: Subject to any disclaimer, the term of this patent is extended or adjusted under 35 U.S.C. 154(b) by 154 days.

(21) Appl. No.: 11/456,678

(22) Filed: Jul. 11, 2006

(65) Prior Publication Data

US 2008/0011109 A1 Jan. 17, 2008

Related U.S. Application Data

(60) Provisional application No. 60/595,513, filed on Jul. 12, 2005.

(51) Int. Cl.
*G01N 19/00* (2006.01)

(52) U.S. Cl. ..... 73/865.9; 73/866.5

(58) Field of Classification Search ..... 73/865.9, 73/865.8, 866.5
See application file for complete search history.

(56) References Cited

U.S. PATENT DOCUMENTS 3,071,636 A * 1/1963 Clark ..... 136/231
3,786,684 A * 1/1974 Wiers et al. ..... 73/866.5
3,955,359 A * 5/1976 Yannone et al. ..... 60/39.281
5,383,355 A * 1/1995 Baleras et al. ..... 73/117.3
5,398,560 A * 3/1995 Zollingger et al. ..... 73/865.8
5,722,230 A * 3/1998 Cohen et al. ..... 60/39.37
5,729,968 A * 3/1998 Cohen et al. ..... 60/39.6
5,913,184 A * 6/1999 Girbig ..... 702/182
6,234,014 B1 * 5/2001 Keyes et al. ..... 73/196
6,397,602 B2 * 6/2002 Vandervort et al. ..... 60/737
6,778,937 B2 * 8/2004 Cleary ..... 702/132
6,978,690 B1 * 12/2005 Van der Heide et al. ..... 73/865
7,010,461 B2 * 3/2006 Draxton et al. ..... 702/182
7,021,126 B1 * 4/2006 Badami et al. ..... 73/112
7,143,659 B2 * 12/2006 Stout et al. ..... 73/865.8
7,222,549 B2 * 5/2007 Abney ..... 73/865.9
2002/0059841 A1 * 5/2002 Pinnerup et al. ..... 73/865.9
2004/0010387 A1 * 1/2004 Girbig ..... 702/113
2004/0183800 A1 * 9/2004 Peterson ..... 345/440
2005/0145018 A1 * 7/2005 Sabata et al. ..... 73/49.1
2006/0010998 A1 * 1/2006 Lloyd et al. ..... 73/866.5

* cited by examiner

*Primary Examiner*—John Fitzgerald
(74) *Attorney, Agent, or Firm*—Blakely, Sokoloff, Taylor & Zafman LLP

(57) ABSTRACT

A method for recording changing boiler conditions over time in three spatial dimensions including: sensing the boiler conditions in real time using sensors which traverse the combustion chamber and gas path generating data from a plurality of positions in one or more supervisory spaces of interest within the boiler system; transmitting the generated data to a computer system; presenting data containing sensor position information and which optionally contains temperature, chemical species information, and other combustor condition information for delivery to a boiler management system to enable said boiler management system to make real time operational adjustments.

21 Claims, 5 Drawing Sheets

METHOD AND SYSTEM FOR DYNAMIC SENSING, PRESENTATION AND CONTROL OF COMBUSTION BOILER CONDITIONS

This is a non-provisional continuation of provisional application No. 60/595,513 filed on Jul. 12, 2005.

References cited: U.S. Pat. Nos. 5,722,230 A, 5,729,968 A, 6,397,602 B1, 6,778,937 B1, 2004/0183800, U.S. Pat. No. 7,010,461 B2. Patent Classification 702/182 and 702/132.

BACKGROUND OF THE INVENTION

Combustion boiler controls allow combustion engineers to optimize boiler performance. To optimize the performance of a boiler, a combustion engineer balances and lowers emissions, e.g., oxygen ($O_2$), nitrogen oxides (NOx) and carbon dioxide ($CO_2$), from the boiler. The boiler has a series of controls to adjust, for example, the amount of fuel and air supplied to a primary combustion zone in the boiler, a reburn zone, and an overfire air zone (exemplary "supervisory spaces of interest"). The boiler heat rate can be improved by increasing oxygen supply but this increases emissions. Having a three dimensional temperature map of the boiler enables the fine adjustment of boiler controls to improve heat rate and reduce emissions.

A boiler is typically measured for temperature and emissions such as NOx at intervals of twelve to eighteen months using high velocity thermocouples (HVT). This process provides a three dimensional map of boiler conditions. The process is carried out manually and the operator can generate three dimensional maps of conditions in the supervisory spaces of interest considered critical for efficient burning of the fuel and the minimization of noxious emissions. Sensor data has not been previously available for conditions at the point of combustion in real time with the location identified in three dimensions. Due to the extremely harsh conditions in the boiler it has not proven feasible to have fixed sensors in the supervisory spaces of interest in the combustion chamber.

Currently, engineers adjust the controls for a boiler combustion system without receiving immediate feedback as to the consequences of their adjustments on emissions and heat rate. Engineers do not see the results of their adjustments until after the data on emissions and heat rate subsequent to the adjustments becomes available for review. Systems exist which provide information about, for example, combustion conditions within the boiler by measuring conditions at a distance from the combustion events for which feedback is required. It would be desirable for engineers to receive prompt emissions and heat rate condition measurements directly from specific supervisory spaces of interest within the boiler to see the effect on emissions and heat rate due to adjustments being made to a boiler based on utilizing said condition measurements.

BRIEF DESCRIPTION OF THE INVENTION

The invention is embodied as a method for recording changing boiler conditions over time in three spatial dimensions including: sensing the boiler conditions in real time using consumable sensors embedded in a carrier object, designed to temporarily withstand the harsh conditions in the boiler, which traverses the combustion chamber and other supervisory space(s) of interest of the boiler generating data from a plurality of positions in the supervisory space(s) of interest within the boiler; capturing data from the sensors of the boiler conditions at a plurality of positions during the traverse of the combustion chamber or other supervisory space(s) of interest of interest in the boiler gas path; wirelessly transmitting the captured data to an antenna situated within the boiler; presenting said captured data containing sensor position information and which may contain temperature, chemical species information, and other boiler condition information for delivery to a computer system; transmitting said data from said computer system to a boiler management system in real time; the sensors being consumed in the boiler waste products collection mechanism.

The invention is optionally embodied as a method for recording changing boiler conditions over time in three spatial dimensions including: sensing the boiler conditions in real time using sensors embedded in a carrier object, designed to temporarily withstand the harsh conditions in the boiler, which traverses the combustion chamber and other supervisory space(s) of interest of the boiler generating data from a plurality of positions in the supervisory space(s) of interest within the boiler; capturing data from the sensors of the boiler conditions at a plurality of positions during the traverse of the combustion chamber or other supervisory space(s) of interest in the boiler gas path; triangulating the position of said sensors by positioning multiple antennas within the boiler; transmitting the captured data to said multiple antennas situated within the boiler; presenting said captured data containing sensor position information and which may contain temperature, chemical species information, and other boiler condition information for delivery to a computer system; transmitting said data from said computer system to a boiler management system in real time; the sensors being consumed in the boiler waste products collection mechanism.

The invention is optionally embodied as a method for recording changing boiler conditions over time in three spatial dimensions including: sensing the boiler conditions in real time using sensors embedded in a carrier object, designed to temporarily withstand the harsh conditions in the boiler which traverses the combustion chamber and other supervisory space(s) of interest of the boiler generating data from a plurality of positions in the supervisory space(s) of interest within the boiler; capturing data from the sensors of the boiler conditions at a plurality of positions during the traverse of the combustion chamber or other supervisory space(s) of interest in the boiler gas path; being retrieved from the boiler by a carrier object retrieval mechanism; extracting the data from said recovered carrier object; presenting data containing sensor position information and which may contain temperature, chemical species information, and other boiler condition information for delivery to a computer system; transmitting said data to a boiler management system in close to real time.

The invention may be also embodied as a method of adjusting a boiler having a combustion chamber comprising: sensing the combustion conditions in a combustion chamber with a plurality of position, temperature, chemical species, and other boiler condition measurement sensors injected into the boiler in a predictable pattern to cover supervisory spaces of interest; generating process values of combustion conditions for delivery to a boiler management system, including position, temperature, chemical species, and other boiler conditions by plotting sensor data captured from the sensors; adjusting the boiler to modify the combustion conditions including increasing or decreasing the amount of air injected, increasing or decreasing the amount of fuel injected, increasing or decreasing the size of fuel particles injected into the boiler in real time; increasing or decreasing the amount of moisture in the boiler or any other parameter that effects heat rate or emissions; generating process values of combustion conditions by plotting sensor data captured subsequent to the boiler adjustment, and repeating until process values of combustion conditions approach an optimum for the dynamic ambient combustion conditions including heat rate and chemical species information.

GENERAL DESCRIPTION OF THE INVENTION

Figure 1:
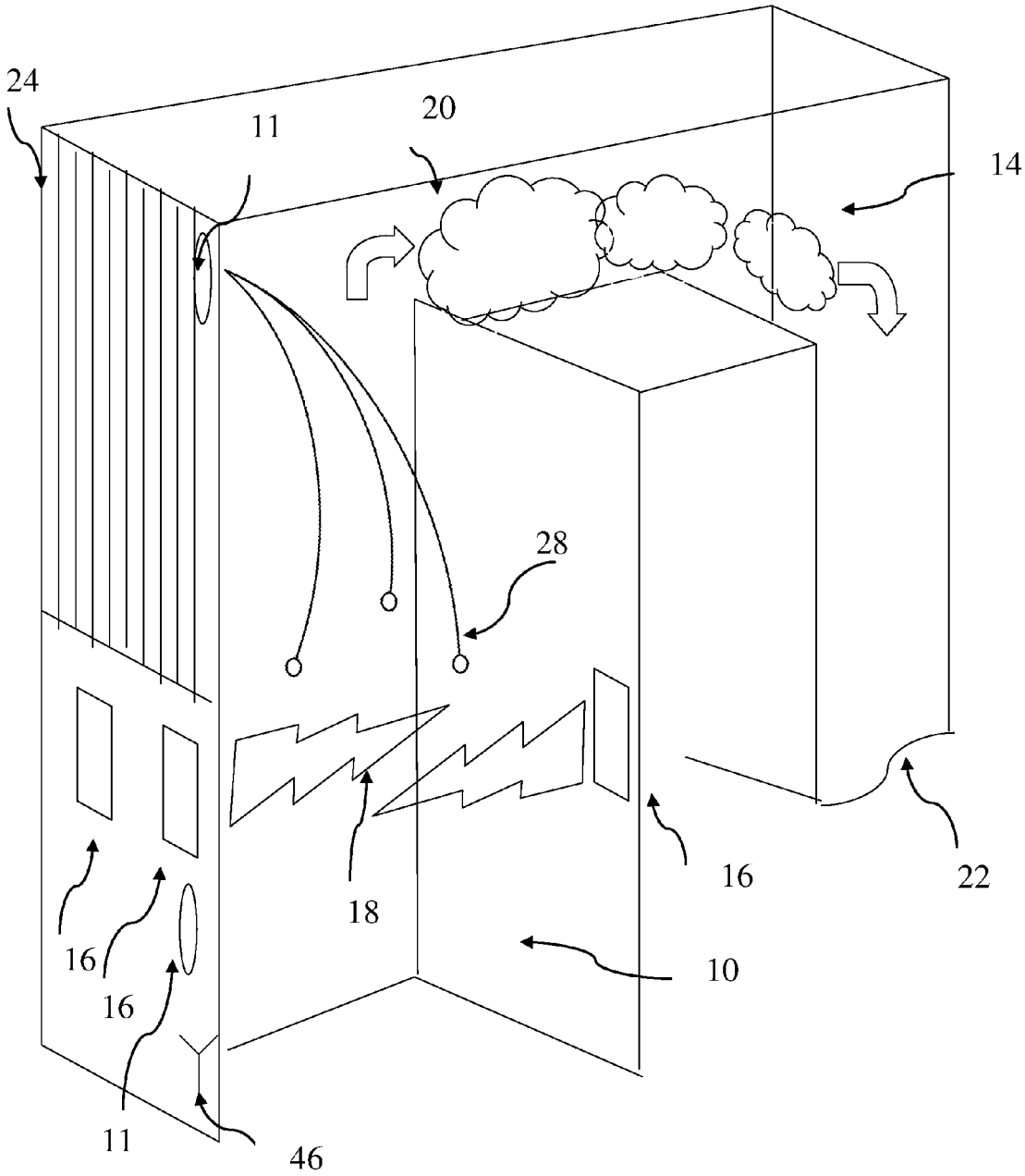
FIG. 1 is a schematic diagram of a boiler shown in cross section during a multiple sensor carrier object injection event.

The invention may be embodied as a method for recording changing boiler conditions in real time by employing sensors embedded in temperature resistant materials traversing the zones of the boiler within which the combusted boiler gases travel from ignition to the exit gas flue.

The invention is designed to provide real time location information as well as chemical species and other information on conditions in the boiler during the traverse. The invention may be embodied as a method for boiler management systems including, for example, automated distributed control systems and neural network systems, and/or manually operated systems, to obtain accurate real time information on boiler conditions and to enable said boiler management systems to make adjustments to critical boiler control functions including fuel and air injectors, and boiler maintenance operations such as cleaning the walls of the boiler.

The invention may be embodied as a method for recording changing conditions in the boiler in four dimensions including three spatial dimensions and time employing a sensor and electronics package embedded in materials selected to survive the harsh combustor environment for up to ten seconds or more but which is consumed in the combustor to avoid the need for recovery. The recorded measurements are communicated wirelessly as while they are traversing the spaces within the boiler system. Optionally the carrier object is designed to be recovered after they have substantially left the boiler system such as in the waste products recovery zone or exit gas flue recovery zone.

The carrier object can take many forms including a carrier object with sufficient mass to enable the injection process to utilize ballistic trajectories. In this instance carrier objects are injected from an elevated position within the combustor with a trajectory passing through various combustor zones under the predominant influence of gravity, subject to the force and angle of injection. The carrier object is protected from the harsh environment by thermal insulation.

Optionally, the carrier object is constructed with low mass but with a surface area sufficient to have enough viscosity to be carried along in the ambient boiler gas flow. Said carrier object optionally has airfoil means for influencing its trajectory. The carrier object can be injected into the boiler at the ambient gas speed.

The sensor and electronics package optionally includes motion sensors, chemical species sensors for measuring combustor gases such as $O_2$, $CO_2$, Nox and others, as well as sensors to measure other environmental conditions such as gas velocity.

For the purpose of this application the area or zone within the boiler that is described by a series of (x, y, z) coordinates from which the boiler operator wishes to extract real time data on operating conditions is referred to as the "supervisory space of interest".

The sensor and electronics package includes a transmitter to transmit data wirelessly to an antenna designed to withstand the harsh conditions within the combustor which is connected to a computer system. The antenna is situated close to the wall of the boiler where temperatures are far lower than in the flame zone of the boiler.

Optionally, multiple such antennas are situated at multiple places within the boiler to transmit and/or receive signals to or from the carrier object.

Optionally, multiple such antennas are situated at multiple places within the boiler to transmit and/or receive signals to or from the carrier object for the purpose of locating the carrier object by triangulation.

The injection mechanism for the carrier objects can be embodied as a simple gravity feed injecting said carrier object with substantially ballistic trajectory for a substantial part of the measurement time in a pattern to adequately cover the supervisory space of interest. When a boiler is designed the boiler fluid dynamics are modeled using computational fluid dynamics (CFD) modeling software, which is available from vendors such as Fluent, Inc. where critical factors and critical areas of the boiler combustion and gas path zones are designed for the boiler size, fuel type and other operating conditions. The CFD model will represent the ideal operating condition. A CFD software vendor can use this invention to confirm in real time that the CFD modeling mathematics represent real time conditions. It also enables the incorporation of the invention into the design of the boiler so that the operator can quickly and cost effectively test operating conditions against the CFD design optimum. In this embodiment the carrier object is sufficiently massive to overcome gas pressure or other operating effects and is injected into the boiler from the ceiling of the boiler. During the fall from the injection point in the ceiling to the bottom of the boiler the physics of objects in free fall will provide location information.

The injector can have a single or multiple unit design such that one or more carrier objects can be simultaneously or sequentially injected. The injection nozzles can be aimed individually or in unison to cover any supervisory space of interest within the boiler. The injectors can release the carrier objects if aimed vertically downwards or impel the carrier objects with a variable force. Said force can be adjusted for each individual injector unit.

Optionally, the carrier object is injected into the boiler with some force. Simple calculations using the mass and shape of the carrier object, the direction of the injection nozzles, and the force used to inject the carrier object will provide a flight path for the carrier object through the boiler. The injection mechanism can be aimed so that any supervisory space of interest can be traversed within the boiler combustor. Optionally, the carrier object can be injected into the boiler at the ambient gas speed.

Injectors are fed by a hopper mechanism enabling multiple injection events to be automated and/or manually operated.

DETAILED DESCRIPTION OF THE INVENTION

FIG. 1 is a schematic cross-sectional diagram of a combustor 10, e.g., a boiler. Several temperature and chemical species information sensors embedded in carrier objects 28 are injected to traverse the combustor to monitor combustion gases within the flame zone 18. The sensors FIG. 4 34,36,38 may, for example, be temperature sensors or chemical sensors which measure the concentration of $CO_2$, $O_2$ and temperature in the combustion gases or motion tracking sensors. Other sensors may also be used to measure other component gas concentrations in the combustor or other conditions of combustor gases such as gas flow speed. The sensors generate signals indicative of the concentration of one or more gases present in the combustor or of the temperature of the combustor gases or other combustor conditions. In practice, any number of carrier objects 28 may be injected into the combustor. The sensors may be injected in a pattern to traverse one or more supervisory space(s) of interest, or in some other sensor pattern. The sensors will continuously transmit data until the traverse is complete.

Optionally, one or more sensor carrier objects 28 are injected into the boiler so as to be carried by the flow of combustion gases through the flame zone 18, the post flame zone 20 and the flue gas duct 14 to capture location and chemical species and temperature measurements along the flight path of the object and to transmit the captured data to wireless antenna(s) variously situated within the boiler.

The combustor 10 may be a large structure, such as more than one, two or even three hundred feet tall. The combustor 10 may include a plurality of combustion devices, e.g., an assembly of combustion fuel nozzles and air injectors 16, which mix fuel and air to generate flame in a flame envelope 18 within the combustor 10. The combustion device 16 may include burners, e.g., gas-fired burners, coal-fired burners and oil-fired burners, etc. The burners may be situated in a wall-fired, opposite-fired, tangential-fired, or cyclone arrangement, and may be arranged to generate a plurality of distinct flames, a common fireball, or any combination thereof. Alternatively, a combustion device called a "stoker" which contains a traveling or vibrating grate may be employed to generate flame within the combustor 10.

When the combustion device(s) 16 in the combustor 10 are actively burning fuel, two distinct locations can be identified within the combustor 10: (1) a flame envelope 18, and (2) a "post-flame" zone 20, which is the zone downstream of the flame envelope 18 spanning some distance toward the flue gas exit 22. Downstream of the flame envelope 18, hot combustion gases and combustion products may be turbulently thrust about. These hot combustion gases and products, collectively called "flue gas," flow from the flame envelope 18, through the "post-flame" zone and towards the exit 22 of the combustor 10. Water or other fluids (not shown) may flow through the walls 24 of the combustor 10 where they may be heated, converted to steam, and used to generate energy, for example, to drive a turbine.

The carrier objects 28 are injected so as to traverse one or more supervisory spaces of interest which may be the flame envelope 18, the post flame zone 20, the flue gas duct 14 of the combustor 10. The sensors are, in this example, an array of sensors injected into the flame envelope 18 and in a particular pattern designed for the flame envelope supervisory space FIG. 2 28 for the combustor such that measurements are made in the supervisory space of interest to the boiler management system. The sensors generate data indicative of the temperature, chemical species information, and other combustor conditions at various points in the space FIG. 2 28 of the flame envelope during the sensors traverse of the space. Based on the data generated from each sensor, a three dimensional map can be generated of the temperature, chemical species, and other combustor conditions in the supervisory space of interest of the flame envelope or other boiler zone.

Figure 2:
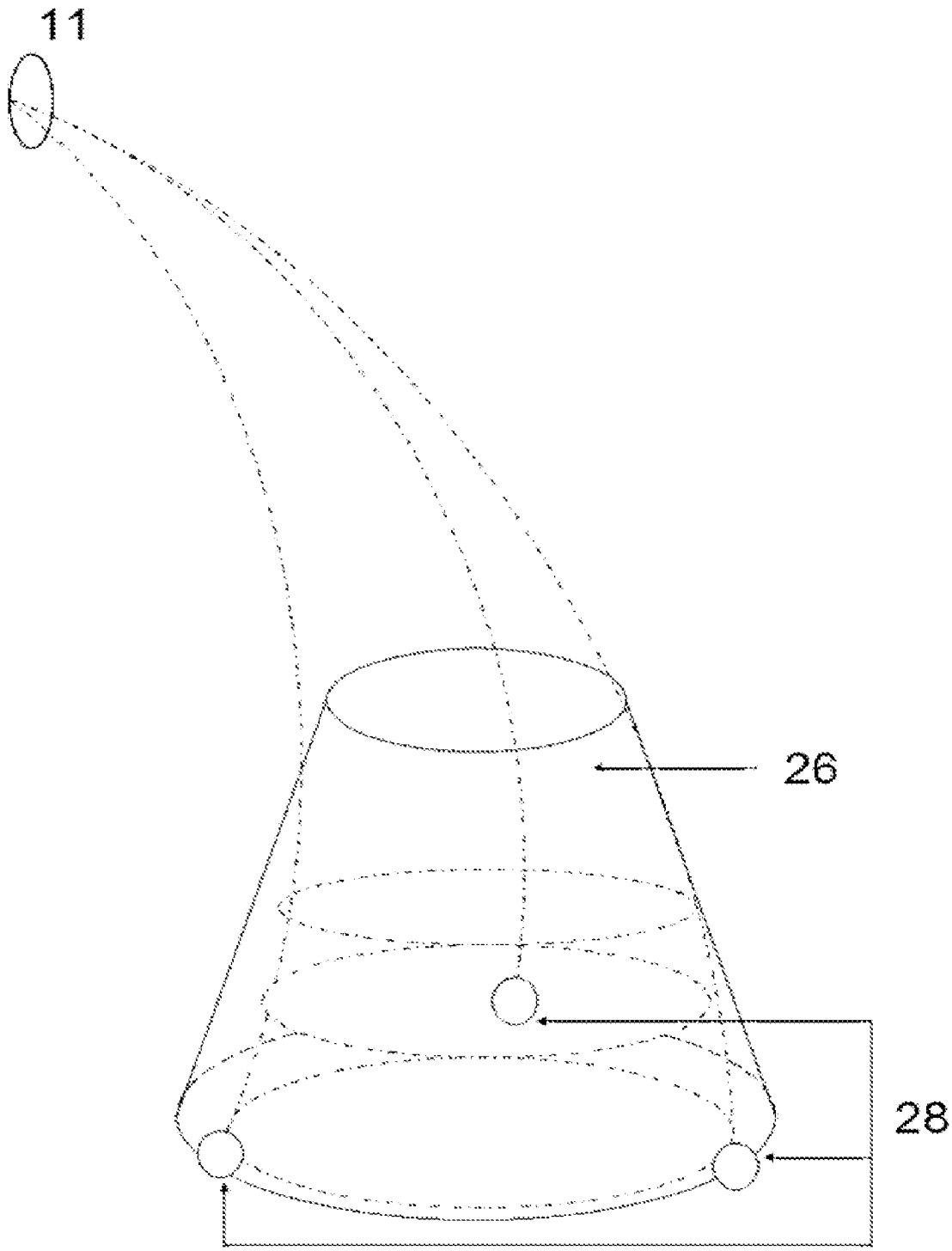
FIG. 2 is a schematic diagram of an injection event showing the passage of the sensor carrier objects through the supervisory spaces of interest.

FIG. 2 is a schematic diagram of an injection event showing the passage of the sensor carrier objects 28 through the supervisory space of interest 26. Measurements are made at time intervals, for example 25 milliseconds, during the trajectory of the sensors through the supervisory space of interest.

Sensors are embedded in a sensor carrier object 28 designed to withstand the harsh high temperature environment for the duration of the traverse event and multiple sensor carrier objects are injected into the boiler in a pattern to saturate the supervisory space of interest 26 in this example in the flame envelope FIG. 1 18. Data is captured at time intervals, for example 25 milliseconds, and the location is determined by the motion tracking sensors. The data is temporarily stored in memory before being transmitted to the data supervision hardware and software module FIG. 4 30 proximate to the receiving boiler antenna FIG. 4 46 and which is connected to the antenna by a protected cable.

Figure 4:
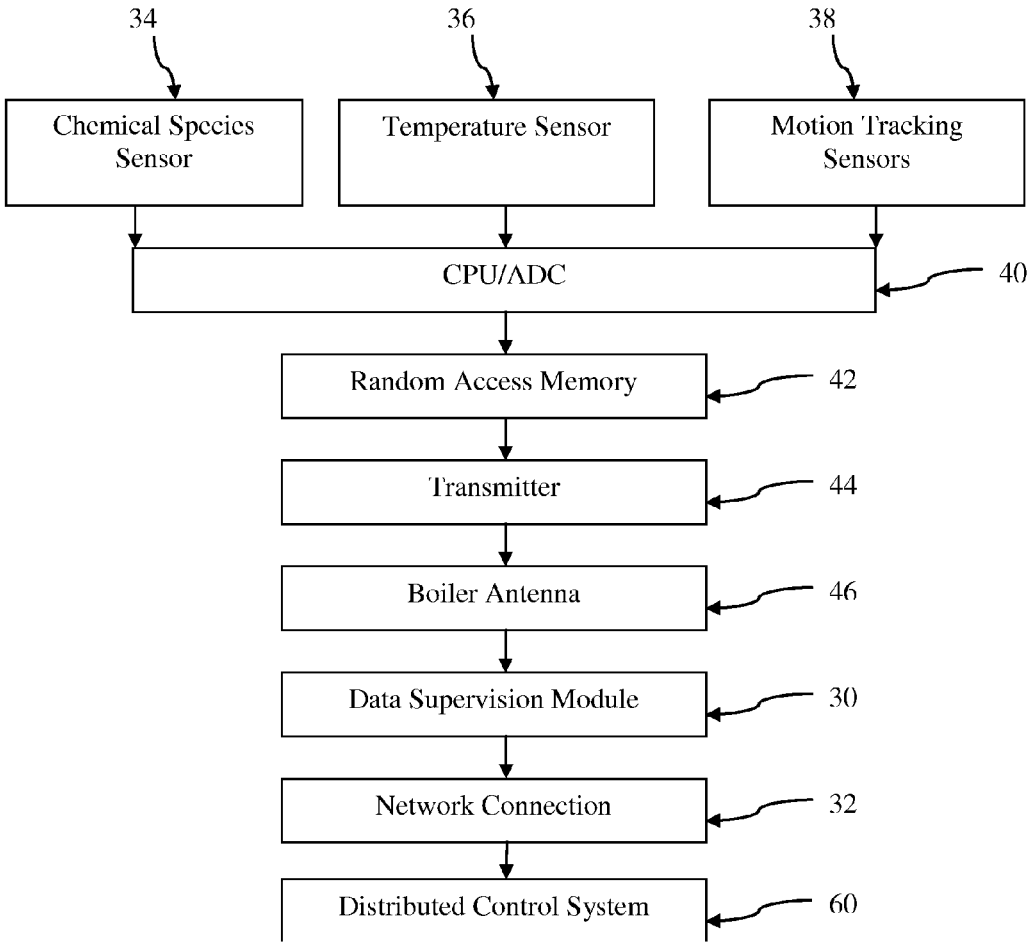
FIG. 4 is a block diagram of electronic and computer components associated with the sensor injection event.

In this embodiment the captured data is wirelessly transmitted from the carrier object transmitter FIG. 4 44 to a boiler antenna FIG. 4 46 attached to the internal wall of the boiler FIG. 1 10. The sensor carrier objects are consumed in the boiler after the completion of the data transmission event. The data captured by the boiler antenna FIG. 4 46 is uploaded by protected cable to the data supervision hardware and software module FIG. 4 30 where it is formatted for delivery to the distributed control system FIG. 4 60 via an Ethernet network.

Optionally, the sensor carrier object may be retrieved from the combustor and the data downloaded to memory in the data supervision hardware and software module FIG. 4 30 for processing and delivery to the distributed control system FIG. 4 60 via an Ethernet network.

Figure 3:
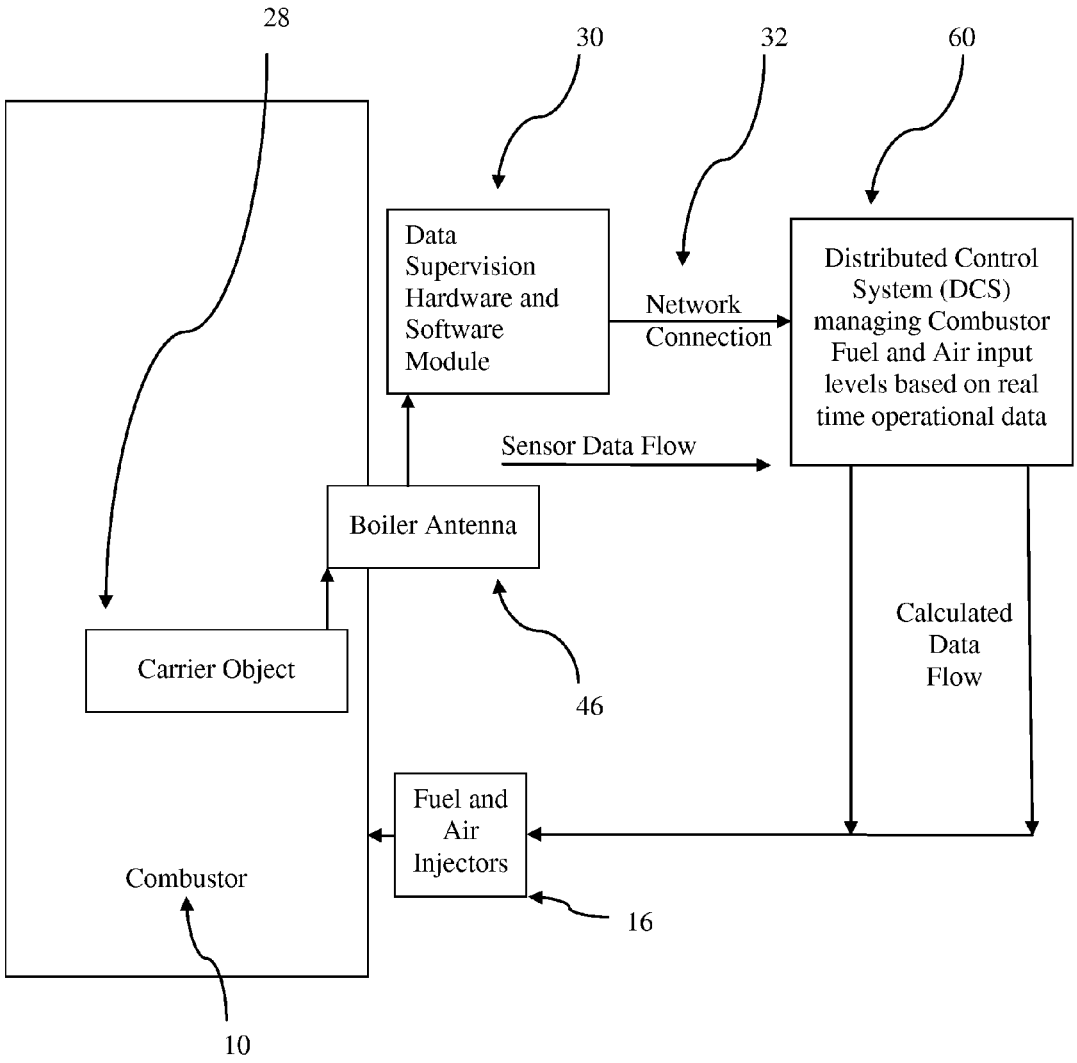
FIG. 3 is a flow chart showing functional components of the carrier object employed in capturing sensor injection event data, processing the data, and generating three dimensional maps for temperature and chemical species information and other useful data regarding conditions in the boiler.

FIG. 3 is a process flow chart of the system feedback loop including sensor carrier object 28 injection event, data capture, and presentation of said data to the combustor distributed or operational control system 60.

Sensor operation is initiated by signal from the motion tracking sensors as motion is detected from the known boiler system injection point FIG. 1 11. The sensor measurements are transmitted by the transmitter FIG. 4 44 in a continuous stream for the duration of the motion of the carrier object through the supervisory space of interest FIG. 2 26 in the combustor FIG. 1 10 by developing said measurements using active circuitry contained within said sensor as it traverses said boiler system. Said measurements producing data at least influencing displays of information provided to operators of said boiler system and said measurements producing data at least influencing operation of said boiler system.

The data acquisition hardware FIG. 4 40 is initiated by signal from the motion tracking sensors FIG. 4 38, for example the Freescale Semiconductor of Texas MMA7260Q three axis accelerometer, as motion is detected from the injection point FIG. 1 11. Data is acquired with reference to a clock of known frequency FIG. 4 40. The data is transmitted FIG. 4 44 in real time to an antenna mounted inside a boiler port FIG. 1 11. The boiler antenna 46 is connected to the data supervision hardware and software module 30 by a protected cable. The data supervision hardware and software module 30 formats the data for delivery to the Distributed Control System 60 via an Ethernet network 32. The Distributed Control System 60 interrogates the data to identify real time conditions in the combustor, compares these to most efficient conditions, and makes adjustments to the operation of the fuel and air injectors 16. The effect of combustor adjustments on the conditions in the combustor can be monitored by initiating another sensor injection event. Optionally, the carrier object location may be determined by estimating the path of said carrier object at least in part by external systems employing ranging techniques to dynamically locate said carrier object.

Alternatively, the carrier object may contain inertial measurement unit sensors, such as the $MAG^3$ unit from MEMsense, LLC of South Dakota or the Piezoelectric Vibrating Gyroscope Gyrostar by muRata of Kyoto, Japan, estimating the path of said carrier object at least in part using the inertial navigation means included along with said carrier object. The movement of the sensor carrier object through the boiler zones FIG. 1 18, 20, and 14 is recorded. Temperature, chemical species information, and other combustor condition sensors FIG. 4 34,36,38 capture data along the path of the sensor carrier object through the combustor zones FIG. 1 18, 20, and 14. Integrating the motion tracking data with the temperature, chemical species information, and other combustor condition information data produces a three dimensional map of the conditions in multiple combustor zones. In this embodiment the sensor carrier object is designed to have a mass and surface volume relationship such that it is sensitive to changes in gas velocity and reacts to ambient gas velocity changes after being injected at the ambient gas velocity at the sensor carrier object injection location.

The Distributed Control System 60 may receive a real-time output of sensor data or (alternatively) access the sensor data in the data supervision hardware and software module 30 by interrogating the data using the data supervision software. The data supervision hardware and software are well known and conventional products. The data supervision hardware may be a conventional computer system with electronic memory. The data supervision software may be conventional database measurement software and software for interfacing with the sensor outputs and capturing the data in usable data form. For example, the sensor interface software may convert sensor readings into data indicative of chemical species information, temperature levels, and other conditions within the combustor.

The Distributed Control System 60 may have a wired or wireless network connection 32 that links the Distributed Control System to the data supervision hardware and software module 30 storing the sensor data.

The Distributed Control System 60 may transmit a database interrogation request to the data supervision hardware and software module 30 to download certain stored sensor data. The requested sensor data may include real time sensor level outputs and historical sensor output levels. The requested data is transferred from the data supervision hardware and software module, over the network connection 32 and to the Distributed Control System 60. The Distributed Control System may temporarily store the sensor data. The Distributed Control System may include neural network software modules. The neural network software can generate instructions to modify the carrier object 28 flight pattern through the combustor to change the three dimensional supervisory space of interest FIG. 2 26 for which new data is desired.

In general, data collected from the sensors flows into the Distributed Control System 60 which is available to the boiler engineer when adjusting the combustion conditions within the combustor. The Distributed Control System processes the sensor data to display to the engineer the sensor data in an easily readable form, such as in a three dimensional map showing emission levels within the supervisory space of interest FIG. 2 26. In addition, the Distributed Control System may perform other processes on the sensor data, such as calculating average emission levels based on all of the sensor output levels from the carrier object sensors FIG. 4 34,36,38. The sensor data processed by the Distributed Control System is presented in a graphical display or output as calculated data which is available to the combustion engineer while adjusting the combustor.

Alternatively, the Distributed Control System 60 may communicate instructions to the combustor air and fuel injectors 16 to make adjustments based on the real time conditions without engineer intervention where the fuel and air injectors are capable of automatic operational adjustments.

FIG. 4 is a flow chart that generally shows the data flow from sensors 34,36,38 to the Distributed Control System 60. The data regarding chemical species information and/or temperature is time stamped and temporarily stored in random access memory 42. The sensor data is converted from an analog to digital signal by the CPU 40. The data is continuously transmitted as a stream of data to the boiler antenna 46 which is connected to the external data supervision hardware and software module 30. Once imported into the data supervision hardware and software module, the sensor data is available for further processing into a three dimensional data array and for aggregation to provide an historical record. Further, the data import module may interrogate the database of sensor readings and time of readings stored in the data supervision hardware and software module 30. The data input module may also include software for downloading sensor data flow over the network connection 32.

The downloaded sensor data is formatted into a database or other form usable by the Distributed Control System 60 by the data supervision hardware and software module. The data supervision hardware and software module temporarily stores the downloaded sensor data and time data so as to provide a database of sensor data available for generating three dimensional data arrays of real time combustor operating conditions used, for example, by the Distributed Control System 60 to calculate emission conditions, and generate the appropriate instructions to send to the combustor air and fuel injectors FIG. 3 16 to improve emission conditions.

Figure 5:
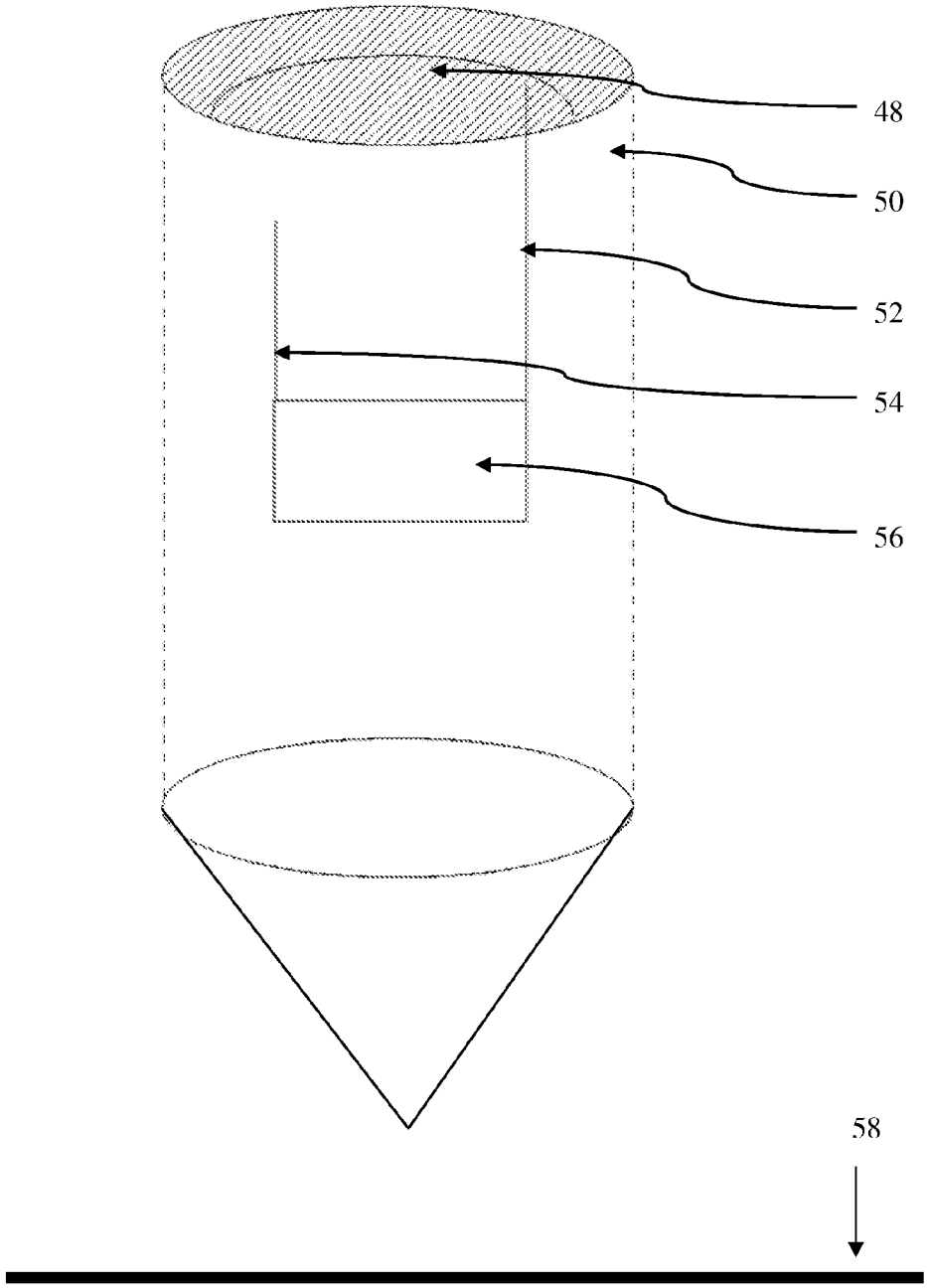
FIG. 5 is a schematic diagram of a carrier object showing the carrier object components and general construction.

FIG. 5 is a schematic of a carrier object wherein the body 50 of the carrier object is constructed of heat resistant materials of various composition depending on the mass of the carrier object. In this exemplary embodiment the carrier object is falling to the bottom of the boiler 58 and the trailing edge of the carrier object is indented and protected by a cover 48 designed to protect the thermocouple 52 tip from incidental damage. The sensor package 56 collects data and transmits it via the carrier object antenna 54 to the receiving boiler antenna FIG. 3 46.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit of the appended claims.

What is claimed is:

1. A system for making a measurement relating to a combustion boiler process and reporting said measurement to an external system, the system comprising:

an un-tethered sensor arranged to travel along a substantially ballistic trajectory within a combustion chamber during operation of the combustion chamber;

said sensor measuring conditions dynamically while traveling along the trajectory within the combustion chamber; and said sensor communicating the measured conditions wirelessly to an external receiver.

2. The system of claim 1, wherein the un-tethered sensor communicating the measured conditions in real time during travel within the combustion chamber.

3. The system of claim 1, wherein the sensor being at least partly protected by thermal insulation.

4. The system of claim 1, wherein the sensor is injected into the combustion chamber with the substantially ballistic trajectory for a substantial part of a measurement time during which the conditions are measured.

5. The system of claim 1, wherein the sensor being influenced by other flows within the combustion chamber so that the sensor deviates from the substantially ballistic trajectory as the sensor travels further into the combustion chamber.

6. The system of claim 1, estimating the path of the sensor at least in part using inertial navigation means included along with the sensor.

7. The system of claim 1 further comprising means for receiving information from the external receiver being an antenna and formatting the information for transmission to a distributed control system over a wired connection.

8. The system of claim 1 wherein a location of the sensor is obtained by triangulation using a plurality of antennas.

9. The system of claim 1 wherein the sensor is a chemical species concentration sensor.

10. The system of claim 1, wherein the sensor includes active circuitry to measure the conditions while traveling through the combustion chamber.

11. The system of claim 1, wherein the sensor includes one or more inertial sensors for estimating a location of the sensor.

12. The system of claim 11 wherein the inertial sensor is from a group consisting of a single axis accelerometer sensor, a dual axis accelerometer, a three axis accelerometer, and an inertial measurement unit sensor.

13. The system of claim 1 wherein the sensor is an optical sensor and is from a group detecting chemical species concentration and temperature.

14. The system of claim 1 wherein the sensor is injected into the combustion chamber with a force predetermined to achieve the trajectory.

15. A boiler sensor system comprising micro electro-mechanical navigation and sensor packages released into a hydrocarbon combustion chamber and said sensors packages transmitting readings, until said measurement packages are destroyed by heat, to external receivers arranged around said combustion chambers and said readings providing input to operator displays and boiler control systems.

16. The boiler sensor system of claim 15 wherein the micro electro-mechanical navigation and sensor packages are released into the combustion chamber on a substantially ballistic trajectory.

17. The boiler sensor system of claim 15, wherein each of the micro electro-mechanical navigation and sensor packages includes one or more inertial sensors for estimating a location of that package.

18. A boiler sensor system comprising:

at least one external receiver; and at least one un-tethered sensor released into a combustion chamber during operation of the combustion chamber, the sensor wirelessly transmitting information to the at least one external receiver.

19. The boiler sensor system of claim 18 wherein the sensor is released into the combustion chamber on a substantially ballistic trajectory.

20. The boiler sensor system of claim 18 wherein the sensor transmits information to at least one external receiver until being destroyed by heat within the combustion chamber.

21. The boiler sensor system of claim 18 further comprising means for receiving information from the external receiver being an antenna and formatting the information for transmission to a distributed control system over a wired connection.

* * * * *